US010721999B2

(12) United States Patent
Norheim et al.

(10) Patent No.: US 10,721,999 B2
(45) Date of Patent: Jul. 28, 2020

(54) DEVICE AND METHOD TO FACILITATE THE OPENING AND CLOSING AND CLOSING OF A SKI BOOT

(71) Applicant: BIRD WITH FRY, CORP., Douglassville, PA (US)

(72) Inventors: Karen Phyllis Norheim, Douglassville, PA (US); Joshua Ernest Fouraker, Wilmington, DE (US); Zachary James Stehouwer, Wayne, PA (US); Cara Michelle Fiala, Philadelphia, PA (US); Donald Richard Fay, III, Boyertown, PA (US); Douglas B. Schumer, Bala Cynwyd, PA (US); Sedat Peker, Upper Darby, PA (US); Vrushti Modi, Ahmedabad (IN)

(73) Assignees: Bird with Fry Corp., Douglassville, PA (US); The Penn State Research Foundation, University Park, PA (US)

( * ) Notice: Subject to any disclaimer, the term of this patent is extended or adjusted under 35 U.S.C. 154(b) by 388 days.

(21) Appl. No.: 15/490,417

(22) Filed: Apr. 18, 2017

(65) Prior Publication Data

US 2017/0303642 A1 Oct. 26, 2017

Related U.S. Application Data

(60) Provisional application No. 62/325,081, filed on Apr. 20, 2016.

(51) Int. Cl.
*A43C 11/00* (2006.01)
*A43C 11/14* (2006.01)

(52) U.S. Cl.
CPC ..... *A43C 11/1466* (2013.01); *A43C 11/1413* (2013.01)

(58) Field of Classification Search
CPC ..... A63C 11/02; A63C 11/025; A63C 11/021; A63C 11/023; A63C 11/005; A63C 11/006; A63C 11/007
See application file for complete search history.

(56) References Cited

U.S. PATENT DOCUMENTS

2009/0058064 A1* 3/2009 Ford, III ..... A63C 11/227 280/824
2011/0099846 A1* 5/2011 Fischer ..... A43B 5/0433 36/117.1

* cited by examiner

*Primary Examiner* — James A Shriver, II
*Assistant Examiner* — James J Triggs
(74) *Attorney, Agent, or Firm* — McNees Wallace & Nurick LLC

(57) ABSTRACT

A device and method to facilitate the opening and closing and closing of a ski boot. The devices includes a buckle attachment section, a ski pole cooperation section and a securing member. The buckle attachment section has a cavity which is dimensioned to receive a free end of the buckle therein to prevent unwanted movement of the buckle attachment section relative to the buckle. The ski pole cooperation section has a ski pole receiving opening. The ski pole receiving opening extends through the ski pole cooperation section and is dimensioned to receive an end of a ski pole therein. The securing member secures the device to the buckle of the ski boot. The device allows the buckles of the ski boot to be latched and unlatched with minimal twisting of the skier's body.

20 Claims, 3 Drawing Sheets

DEVICE AND METHOD TO FACILITATE THE OPENING AND CLOSING AND CLOSING OF A SKI BOOT

RELATED APPLICATION

This application claims the benefit under 35 U.S.C. § 119(e) to U.S. Provisional Application Ser. No. 62/322,435 filed Apr. 20, 2016, and entitled "SKI BOOT OPENER," the entirety of which is incorporated herein by reference.

FIELD OF THE INVENTION

The invention is directed to a device and method for latching and unlatching the buckles of a ski boot. In particular, the invention is directed to a buckle attachment device and method which minimizes the amount of movement required to latch (close) and unlatch (open) a ski boot.

BACKGROUND OF THE INVENTION

Tight fitting ski boots are a necessity for skiers. For a ski boot to transmit the action of the skier to the ski, it must be tight, meaning the boot is snug everywhere around the foot. In general, the tighter the boot, the better. The temperature of the ski boot changes throughout the day. Boots are stiffer when it is cold, so if the boot feels stiff in the store, it will be too stiff on the slopes. Skiers may also find that the boots loosen up throughout the day, so they may need to readjusted during a lunch break. Also when skiers take a break for lunch, loosening up the buckles can give their feet a nice break. This creates a situation where ski boots have to be tightened and loosened numerous times throughout the day.

Ski boots attach the skier to the skis using bindings. Modern alpine ski boots are front-entry boots. The back of the boot is fixed and the adjustments are located on the front. Ski boots consist of two sections: one section around the foot and one section around the lower leg. This allows the skier to push forward with their shin, leaning over the skis. No lateral movement is possible. Typically, ski boots typically have four buckles and one strap for tightening and loosening. Two buckles are located at the lower leg section and two are located at the foot section. Ski boots are typically made of plastic with either aluminum or titanium buckles. The upper part of the boot is tightened with a hook and loop strap.

Skiers have difficulties latching and unlatching their ski boots. The tightness of each buckle is based on an individual's preference. With a tight fitting ski boot, the skier has the expectation that every movement of the foot is translated into an immediate response of the ski. With a looser fitting boot, the skier's feet will most likely feel more comfortable. Skiers often unlatch their boots on the lift ride and relatch for skiing downhill. It is important to also consider that the boots are exposed to changing temperatures and weather conditions throughout the ski day which may present the need for frequent adjustments of the boot. The boot latches can be difficult to adjust by hand because they are located at the lower leg and top of the foot. Bending and twisting of the torso is required to access the latches. However, due to the cold, personal inabilities, and attire, skiers find it difficult to bend or twist to open and close their ski boot latches.

Ski boot latches can be difficult to adjust by hand for several reasons. Ski boot closure latches are typically relatively stiff and difficult to close, particularly in cold, snowy or icy conditions, or if adjusted to a very tight fit. The skier will normally be wearing padded gloves which also adds to the difficulty of closing two or more rigid, pivotal clasps. These factors typically make handling of ski boot closures or clasps rather awkward and particularly difficult for those having limited dexterity or strength as a result of cold or for other reasons, for example women, children or anyone with a limited grip.

For a person to adjust their ski boots while standing, they must bend their torso approximately 90 degrees. The latches at the top of the boot require a lateral force. These latches are on the side of the boot so the torso must also rotate approximately 30 degrees. Latches on the bottom of the boot require further bending and an upward force. This can be difficult for elderly people, young children, or people with injuries. Reducing bending and twisting benefits the skier because it requires less work to open or close the ski boot buckle.

While tools are known that can assist in opening and closing the latch, none of these known tools significantly reduce the amount of bending and twisting required by the user when using these know tools. In addition, know tools are separate items which must be carried by the user; they are not attached to the ski boot.

It would, therefore, be beneficial to provide a device and method which facilitates the latching and unlatching of the boot buckles while minimizing the amount of movement required to latch and unlatch a ski boot.

SUMMARY OF THE INVENTION

An object is to provide a device and method that will: allow users to easily, and with minimal force, actuate the buckles; be easy to install and maintain on existing buckles; be aesthetically pleasing; function with limited user effort; and/or reduce bending and twisting of the user.

An embodiment is directed to a device provided on a buckle of a ski boot. The device includes a buckle attachment section, a ski pole cooperation section and a securing member which secures the device to the buckle of the ski boot.

An embodiment is directed to a device provided on a buckle of a ski boot. The devices includes a buckle attachment section, a ski pole cooperation section and a securing member. The buckle attachment section has a cavity which is dimensioned to receive a free end of the buckle therein to prevent unwanted movement of the buckle attachment section relative to the buckle. The ski pole cooperation section has a ski pole receiving opening. The ski pole receiving opening extends through the ski pole cooperation section and is dimensioned to receive an end of a ski pole therein. The securing member secures the device to the buckle of the ski boot. The device allows the buckles of the ski boot to be latched and unlatched with minimal twisting of the skier's body.

An embodiment is directed to a buckle of a ski boo which includes a ski pole cooperation section. A ski pole receiving opening is provided in the ski pole cooperation section. The ski pole receiving opening extends through the ski pole cooperation section and is dimensioned to receive an end of a ski pole therein. The user inserts the tip of the ski pole in the ski pole receiving opening to operate the buckle.

An embodiment is directed to a method of latching or unlatching a buckle of a ski boot. The method includes: positioning a buckle attachment device onto a free end of the buckle; securing the buckle attachment device onto the free end of the buckle; inserting an end of a ski pole into a ski pole receiving opening of the buckle attachment device; and exerting force on the ski pole which causes a force to be exerted on the buckle attachment device and the buckle to move the buckle between a latched position and an unlatched position.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
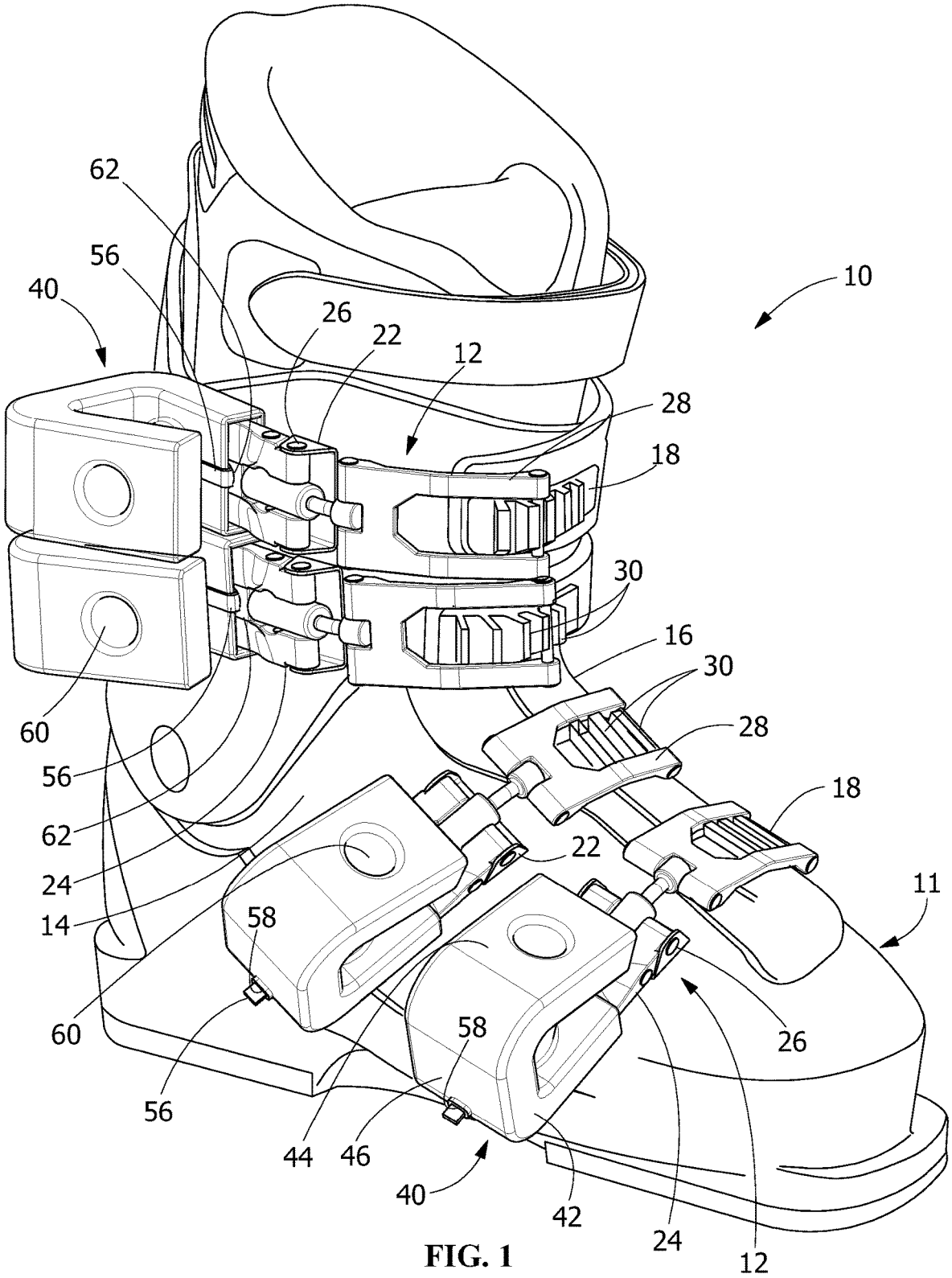
FIG. 1 is a perspective view of a ski boot with illustrative buckle attachment members of the present invention attached to the ski boot buckles.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

A ski boot 10 including pivotal buckles 12 is shown in FIG. 1. In the illustrative embodiment shown, the ski boot 10 includes four buckles 12, but other numbers of buckles can be used. The ski boot 10 includes an outer shell 11 including an outer half 14 and an instep half 16, instep half 16 being slideable in relation to outer half 14 to provide for adjustment of the tightness of the boot on the foot of the skier. The instep half 16 includes a notched member 18 extending therefrom which provides for securement of one end of the buckle 12. In the illustrative embodiment shown, buckle 12 is a two part member. However, other types of straps can be used.

The outer half 14 includes an anchor 22 extending therefrom which provides for securement of one end of a first portion 24 of buckle 12. The first portion 24 of the buckle 12 has a generally elongated shape and is pivotally attached to anchor 22 at pivot 26. A second portion 28 of buckle 12 extends from the first portion 24 toward the notched member 18. The second portion 28 of buckle 12 cooperates with a plurality of teeth 30 of the notched member 18.

The second portion 28 of buckle 12 may be releasably positioned within the gaps between the teeth 30. The tightness of the boot 10 will be determined by the respective gap in which the second portion 28 of buckle 12 is positioned. For example, if the end of the second portion 28 of buckle 12 is positioned in the gap positioned proximate the pivot 26, the boot 10 will be relatively loose because instep half 16 of the shell slides a relatively small distance in relation to outer half 14 when the buckle 12 is pivoted clockwise to the closed position. As the distance between the gap in which second portion 28 of buckle 12 is positioned and the pivot 26 is increased, the tightness of the boot 10 is increased. For example, if the end of the second portion 28 of buckle 12 is positioned in the gap positioned furthest from the pivot 26, the boot 10 will be relatively tight because instep half 16 of the shell slides a relatively large distance in relation to outer half 14 when the buckle 12 is pivoted clockwise to the closed position.

Figure 2:
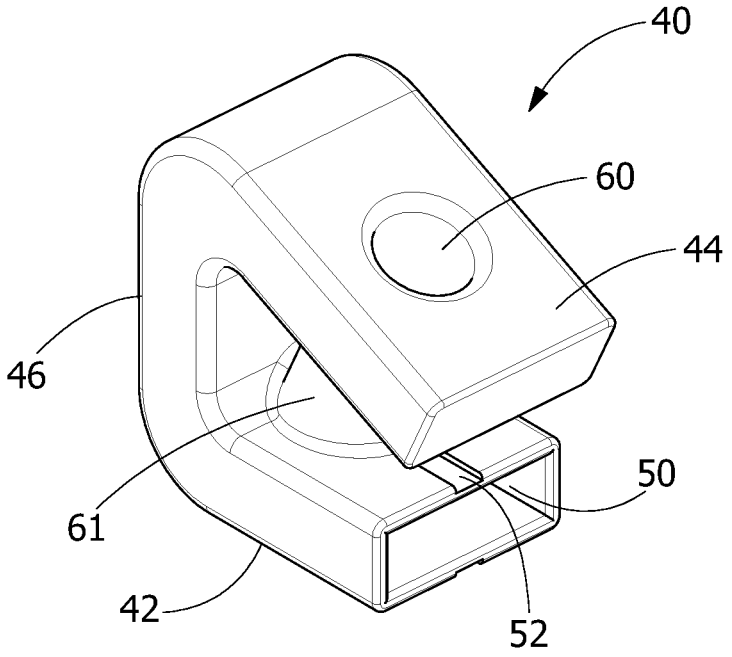
FIG. 2 is a top perspective view of a buckle attachment member as shown in FIG. 1.
Figure 3:
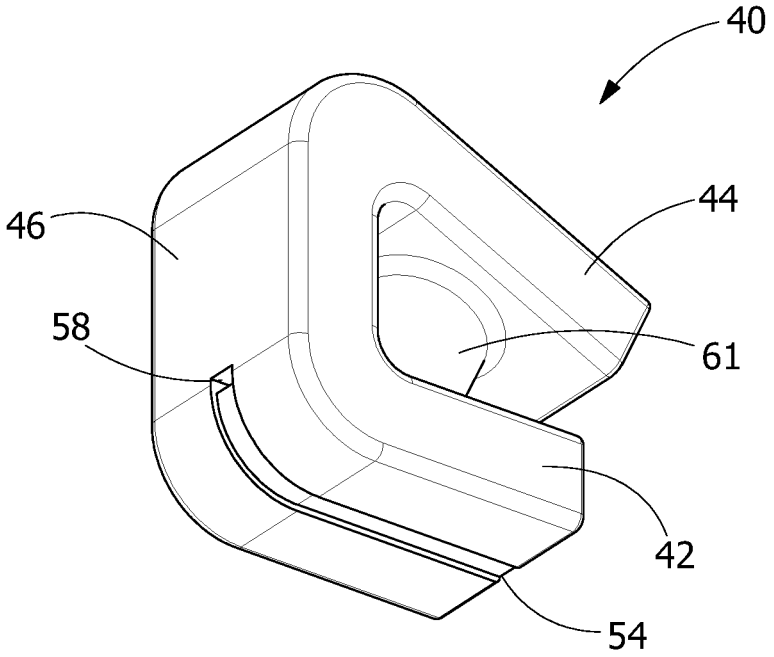
FIG. 3 is a bottom perspective view of the buckle attachment member of FIG. 2.

As shown in FIG. 1, a buckle attachment device 40 is provided at a free end of each of the first portions 24 of the buckles 24. As best shown in FIGS. 2 and 3, the buckle attachment device 40 has a buckle attachment section 42, a ski pole cooperation section 44 and a transition section 46 which extends between the buckle attachment section 42 and the ski pole cooperation section 44. In the embodiment shown, the ski pole cooperation section 44 is positioned above the buckle attachment section 42 with the plane of the ski pole cooperation section 44 and at an angle relative to the plane of the buckle attachment section 42. The angle of the ski pole cooperation section 44 being approximately 30 degrees, 45 degrees, between 20 degrees and 60 degrees. Alternatively, the ski pole cooperation section 44 may be essentially parallel to the plane of the buckle attachment section 42.

The buckle attachment section 42 has a cavity 50 (FIG. 2) which is dimensioned to receive the free end of the first portion 24 of the buckle 12 therein. The cavity 50 is dimensioned to snugly receive the free end to prevent unwanted movement of the buckle attachment section 42 relative to the buckle 12.

A first recess 52 may be provided in a top surface of the buckle attachment section 42. A second recess 54 may be provided in a bottom surface of the buckle attachment section 42. The recesses 52, 54 are positioned in general alignment for receiving a securing member 56 (FIG. 1) therein. In the embodiment shown, the securing member 56 is a zip tie, but other types of securing members can be used without departing from the scope of the invention. In various embodiments, the first or second recess 52, 54 may extend partially through the respective top or bottom surface. Alternatively, either the first or second recess 52, 54 may extend entirely through the respective top or bottom surface of the buckle attachment section 42.

The transition section 46 extends between and is integrally formed with the buckle attachment section 42 and the ski pole cooperation section 44. An opening 58 is provided in the transition section 46 to allow the securing member 56 to extend therethrough.

The ski pole cooperation section 44 is spaced from the buckle attachment section 42. A ski pole receiving opening 60 is provided in the ski pole cooperation section 44. The ski pole receiving opening 60 extends through the ski pole cooperation section 44 and is dimensioned to receive an end of a ski pole therein. The opening 60 is positioned in-line with a ski pole receiving cylinder 61 which extends from a bottom surface of the ski pole cooperation section 44 toward the buckle attachment section 42. In the illustrative embodiment shown, the ski pole receiving cylinder 61 engages the buckle attachment section 42 to provide additional stability to the ski pole cooperation section 44 and the buckle attachment device 40. The ski pole receiving cylinder 61 is dimensioned to receive an end of a ski pole therein.

In use, the buckle attachment section 42 of the buckle attachment device 40 is inserted onto the free end of the first portion 24 of the buckle 12. In this position, free end of the first portion 24 of the buckle 12 is received in the cavity 50. While the cavity 50 is dimensioned to snugly receive the free end to prevent unwanted movement of the buckle attachment section 42 relative to the buckle 12, additional securing of the buckle attachment section 42 to the buckle 12 is generally required to prevent the unwanted removal of the buckle attachment device 40 from the buckle 12. As best shown in FIG. 1, the securing member 56 extends through an opening 62 in the buckle 12 and through the opening 58 in the transition section 46. The securing member 56 is tightened to firmly maintain the buckle attachment device 40 in position on the buckle 12. In this position, the securing member 56 is positioned in the recesses 52, 54.

In alternative embodiments, the securing member 56 may be adhesive or the like which is positioned between the buckle attachment section 42 of the buckle attachment device 40 and the free end 34 of the buckle 12. In other alternative embodiments, the securing member 56 may be metal screws, other mounting hardware, or other small components for mounting purposes.

With the buckle attachment device 40 properly secured to the buckle 12, the buckle attachment device 40 is used to facilitate the latching or closing and the unlatching or opening of the buckle 12.

When moving the buckle 12 from the open or unlatched position to the closed or latched position, the user inserts the end of the pole into the ski pole receiving opening 60 and the ski pole receiving cylinder 61. With the pole properly inserted into the ski pole receiving opening 60 and the ski pole receiving cylinder 61, the user rotates their arm and exerts force or pushes down on the pole, thereby causing force to be exerted on the buckle attachment device 40 and the buckle 12, causing the buckle 12 to be moved from the open or unlatched position to the closed or latched position.

When moving the buckle 12 from the closed or latched position to the open or unlatched position, the user inserts the end of the pole into the ski pole receiving opening 60 and the ski pole receiving cylinder 61. With the pole properly inserted into the ski pole receiving opening 60 and the ski pole receiving cylinder 61, the user rotates their arm and exerts force or pulls up on the pole, thereby causing force to be exerted on the buckle attachment device 40 and the buckle 12, causing the buckle 12 to be moved from the closed or latched position to the open or unlatched position.

The use of the buckle attachment device 40 and the method described allows the user to actuate both top and bottom buckles with the ski pole, thereby minimizing the user's efforts. Because the skier is applying a torque with their ski pole, they are able to actuate the buckles 12 with minimal effort and minimal strain.

Figure 4:
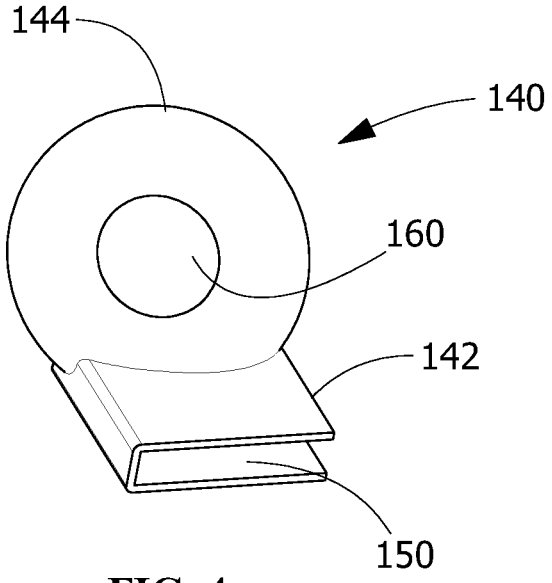
FIG. 4 is a top perspective view of a second illustrative embodiment of a buckle attachment member of the present invention.

A second illustrative embodiment of a buckle attachment 140 is shown in FIG. 4. The buckle attachment 140 has a buckle attachment section 142 and a ski pole cooperation section 144. In the embodiment shown, the ski pole cooperation section 144 extends at an angle relative to the buckle attachment section 142.

The buckle attachment section 142 has a cavity 150 which is dimensioned to receive the free end of the first portion 24 of the buckle 12 therein. The cavity 150 is dimensioned to snugly receive the free end to prevent unwanted movement of the buckle attachment section 142 relative to the buckle 12.

The ski pole cooperation section 144 has a ski pole receiving opening 160 which extends through the ski pole cooperation section 144 and is dimensioned to receive an end of a ski pole therein.

In use, the buckle attachment section 142 of the buckle attachment 140 is inserted onto the free end of the first portion 24 of the buckle 12. In this position, free end of the first portion 24 of the buckle 12 is received in the cavity 150. While the cavity 150 is dimensioned to snugly receive the free end to prevent unwanted movement of the buckle attachment section 142 relative to the buckle 12, additional securing of the buckle attachment section 142 to the buckle 12 is generally required to prevent the unwanted removal of the buckle attachment 140 from the buckle 12. In this embodiment, the securing member extends through an opening 62 in the buckle 12 and through the ski pole receiving opening 160. The securing member is tightened to firmly maintain the buckle attachment 140 in position on the buckle 12.

In alternative embodiments, the securing member may be adhesive or the like which is positioned between the buckle attachment section 142 of the buckle attachment 140 and the free end of the first portion 24 of the buckle 12. In other alternative embodiments, the securing member 156 may be metal screws, other mounting hardware, or other small components for mounting purposes.

With the buckle attachment 140 properly secured to the buckle 12, the buckle attachment 140 is used to facilitate the latching or closing and the unlatching or opening of the buckle 12.

When moving the buckle 12 from the open or unlatched position to the closed or latched position, the user inserts the end of the pole into the ski pole receiving opening 160. With the pole properly inserted into the ski pole receiving opening 160, the user rotates their arm and exerts force or pushes down on the pole, thereby causing force to be exerted on the buckle attachment 140 and the buckle 12, causing the buckle 12 to be moved from the open or unlatched position to the closed or latched position.

When moving the buckle 12 from the closed or latched position to the open or unlatched position, the user inserts the end of the pole into the ski pole receiving opening 160. With the pole properly inserted into the ski pole receiving opening 160, the user rotates their arm and exerts force or pulls up on the pole, thereby causing force to be exerted on the buckle attachment 140 and the buckle 12, causing the buckle 12 to be moved from the closed or latched position to the open or unlatched position.

The use of the buckle attachment 140 and the method described allows the user to actuate both top and bottom buckles with the ski pole, thereby minimizing the user's efforts. Because the skier is applying a torque with their ski pole, they are able to actuate the buckles 24 with minimal effort and minimal strain.

Figure 5:
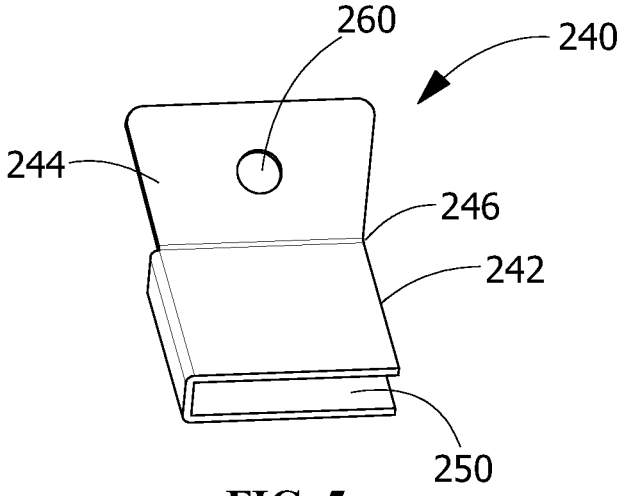
FIG. 5 is a top perspective view of a third illustrative embodiment of a buckle attachment member of the present invention.

A third illustrative embodiment of a buckle attachment 240 is shown in FIG. 5. The buckle attachment 240 has a buckle attachment section 242, a ski pole cooperation section 244 and a transition section 246. In the embodiment shown, the ski pole cooperation section 244 and the transition section 246 extend in essentially the same plan as the buckle attachment section 242.

The buckle attachment section 242 has a cavity 250 which is dimensioned to receive the free end of the first portion 24 of the buckle 12 therein. The cavity 250 is dimensioned to snugly receive the free end to prevent unwanted movement of the buckle attachment section 242 relative to the buckle 12.

The ski pole cooperation section 244 extends beyond the free end of the first portion 24 of the buckle 12 and has a ski pole receiving opening 260 which extends through and upper surface of the ski pole cooperation section 244 and is dimensioned to receive an end of a ski pole therein.

The transition section 246 extends between and is integrally formed with the buckle attachment section 242 and the ski pole cooperation section 244. The transition section 246 has a reduced width or necked-down portion with respect to the buckle attachment section 242. Alternatively, the transition portion 246 may have a consistent width to the buckle attachment section 242.

In use, the buckle attachment section 242 of the buckle attachment 240 is inserted onto the free end of the first portion 24 of the buckle 12. In this position, free end of the first portion 24 of the buckle 12 is received in the cavity 250. While the cavity 250 is dimensioned to snugly receive the free end to prevent unwanted movement of the buckle attachment section 242 relative to the buckle 12, additional securing of the buckle attachment section 242 to the buckle 12 is generally required to prevent the unwanted removal of the buckle attachment 240 from the buckle 12. In this embodiment, the securing member extends through an opening 62 in the buckle 12 and through the ski pole receiving opening 260. The securing member is tightened to firmly maintain the buckle attachment 240 in position on the buckle 12.

In alternative embodiments, the securing member may be adhesive or the like which is positioned between the buckle attachment section 242 of the buckle attachment 240 and the free end 34 of the buckle 12. In other alternative embodiments, the securing member may be metal screws, other mounting hardware, or other small components for mounting purposes.

With the buckle attachment 240 properly secured to the buckle 12, the buckle attachment 240 is used to facilitate the latching or closing and the unlatching or opening of the buckle 12.

When moving the buckle 12 from the open or unlatched position to the closed or latched position, the user inserts the end of the pole into the ski pole receiving opening 260. With the pole properly inserted into the ski pole receiving opening 260, the user rotates their arm and exerts force or pushes down on the pole, thereby causing force to be exerted on the buckle attachment 240 and the buckle 12, causing the buckle 12 to be moved from the open or unlatched position to the closed or latched position.

When moving the buckle 12 from the closed or latched position to the open or unlatched position, the user inserts the end of the pole into the ski pole receiving opening 260. With the pole properly inserted into the ski pole receiving opening 260, the user rotates their arm and exerts force or pulls up on the pole, thereby causing force to be exerted on the buckle attachment 240 and the buckle 12, causing the buckle 12 to be moved from the closed or latched position to the open or unlatched position.

The use of the buckle attachment 240 and the method described, allows the user to actuate both top and bottom buckles with the ski pole, thereby minimizing the user's efforts. Because the skier is applying a torque with their ski pole, they are able to actuate the buckles 24 with minimal effort and minimal strain.

Figure 6:
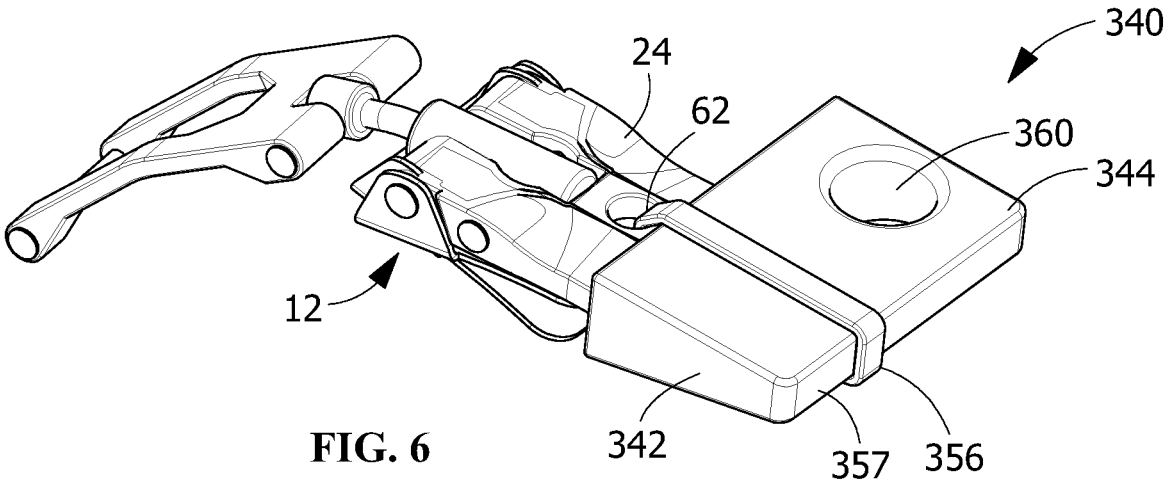
FIG. 6 is a top perspective view of a fourth illustrative embodiment of a buckle attachment member of the present invention.

A fourth illustrative embodiment of a buckle attachment 340 is shown in FIG. 6. The buckle attachment 340 has a buckle attachment section 342 and a ski pole cooperation section 344. In the embodiment shown, the ski pole cooperation section 344 extends in essentially the same plan as the buckle attachment section 342.

The buckle attachment section 342 has a cavity (not shown) which is dimensioned to receive the free end of the first portion 24 of the buckle 12 therein. The cavity 350 is dimensioned to snugly receive the free end 34 to prevent unwanted movement of the buckle attachment section 342 relative to the buckle 12.

The ski pole cooperation section 344 extends to the side of the free end of the first portion 24 of the buckle 12 and has a ski pole receiving opening 360 which extends through an upper surface of the ski pole cooperation section 344 and is dimensioned to receive an end of a ski pole therein.

In use, the buckle attachment section 342 of the buckle attachment 340 is inserted onto the free end of the first portion 24 of the buckle 12. In this position, free end of the first portion 24 of the buckle 12 is received in the cavity. While the cavity is dimensioned to snugly receive the free end to prevent unwanted movement of the buckle attachment section 342 relative to the buckle 12, additional securing of the buckle attachment section 342 to the buckle 12 is generally required to prevent the unwanted removal of the buckle attachment 340 from the buckle 12. In this embodiment, the securing member 356 extends through an opening 62 in the buckle 12 and over an end 357 of the buckle attachment section 342. The securing member 356 is tightened to firmly maintain the buckle attachment 340 in position on the buckle 12.

In alternative embodiments, the securing member 356 may be adhesive or the like which is positioned between the buckle attachment section 342 of the buckle attachment 340 and the free end of the first portion 24 of the buckle 12. In other alternative embodiments, the securing member 356 may be metal screws, other mounting hardware, or other small components for mounting purposes.

With the buckle attachment 340 properly secured to the buckle 12, the buckle attachment 340 is used to facilitate the latching or closing and the unlatching or opening of the buckle 12.

When moving the buckle 12 from the open or unlatched position to the closed or latched position, the user inserts the end of the pole into the ski pole receiving opening 360. With the pole properly inserted into the ski pole receiving opening 360, the user rotates their arm and exerts force or pushes down on the pole, thereby causing force to be exerted on the buckle attachment 340 and the buckle 12, causing the buckle 12 to be moved from the open or unlatched position to the closed or latched position.

When moving the buckle 12 from the closed or latched position to the open or unlatched position, the user inserts the end of the pole into the ski pole receiving opening 360. With the pole properly inserted into the ski pole receiving opening 360, the user rotates their arm and exerts force or pulls up on the pole, thereby causing force to be exerted on the buckle attachment 340 and the buckle 12, causing the buckle 12 to be moved from the closed or latched position to the open or unlatched position.

The use of the buckle attachment 340 and the method described allows the user to actuate both top and bottom buckles with the ski pole, thereby minimizing the user's efforts. Because the skier is applying a torque with their ski pole, they are able to actuate the buckles 24 with minimal effort and minimal strain.

For any of the embodiments of the invention, the method of latching or unlatching the buckle of a ski boot, includes: positioning a buckle attachment device onto a free end of the buckle; securing the buckle attachment device onto the free end of the buckle; inserting an end of a ski pole into a ski pole receiving opening of the buckle attachment device; and exerting force on the ski pole which causes a force to be exerted on the buckle attachment device and the buckle to move the buckle between a latched position and an unlatched position.

In order to latch or close the buckle, the force exerted on the ski pool pushes the buckle attachment device causing the buckle to move to the latched position. Alternatively, in order to unlatch or open the buckle, the force exerted on the ski pool pulls the buckle attachment device causing the buckle to move to the unlatched position. In either case, the skier rotates their arm to exert the force on the ski pole.

The buckle attachment device has the capability of actuating the ski boot, ultimately latching and unlatching the buckle as the skier's hand would. It allows the skier to actuate the latches with minimal or no bending or twisting of the skier's waist or body.

The buckle attachment device can be used when the skier chooses to actuate their boot buckles before or after a run down the hill or when the skier decides to relax inside for some time. The buckle attachment device does not interfere with the skier's equilibrium, as the buckle attachment device has minimal weight and size.

The buckle attachment device can be used for tightening and loosening boots in any weather or winter weather sport environments.

The buckle attachment device may be made of any material having the strength characteristics required, including, but not limited to, plastic or metal. The buckle attachment device may come in different sizes, patterns and colors.

The buckle attachment device allows the top and bottom buckles to actuate while minimizing the skier's efforts. The user inserts the tip of the ski pole in the ski pole receiving opening to operate (i.e., latch and unlatch the buckle). Because the skier is applying a torque with their ski pole, they are able to actuate them with minimal effort. The skier will not have to bend 90 degrees at the waist to reach the buckle with their hands.

In the embodiments shown, the buckle attachment device is shown as a separate member which is inserted onto the buckle. However, the invention is not limited to a device or buckle attachment device which is separated from the buckle. For example, the buckle attachment device may be integrally formed or manufactured with the buckle, wherein the buckle attachment section and the ski pole cooperation section are portions of the buckle.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A device provided on a buckle of a ski boot, the device comprising:

a buckle attachment section;

a ski pole cooperation section;

a securing member which secures the device to the buckle of the ski boot.

2. The device as recited in claim 1, wherein a transition section extends between the buckle attachment section and the ski pole cooperation section, the ski pole cooperation section is positioned above the buckle attachment section.

3. The device as recited in claim 2, wherein the transition section has an opening to allow the securing member to extend therethrough.

4. The device as recited in claim 1, wherein the buckle attachment section has a cavity which is dimensioned to receive a free end of the buckle therein to prevent unwanted movement of the buckle attachment section relative to the buckle.

5. The device as recited in claim 1, wherein a first recess is provided in a top surface of the buckle attachment section, the first recess dimensioned to receive a securing member therein.

6. The device as recited in claim 5, wherein the first recess extends entirely through the top surface of the buckle attachment section.

7. The device as recited in claim 5, wherein a second recess is provided in a bottom surface of the buckle attachment section, the second recess dimensioned to receive the securing member therein.

8. The device as recited in claim 1, wherein the securing member is a zip tie.

9. The device as recited in claim 1, wherein the securing member is adhesive.

10. The device as recited in claim 1, wherein the securing member is mounting hardware.

11. The device as recited in claim 1, wherein a ski pole receiving opening is provided in the ski pole cooperation section, the ski pole receiving opening extends through the ski pole cooperation section and is dimensioned to receive an end of a ski pole therein.

12. The device as recited in claim 1, wherein the ski pole cooperation section extends at an angle relative to the buckle attachment section.

13. The device as recited in claim 1, wherein the ski pole cooperation section extends in the same plane as the buckle attachment section.

14. The device as recited in claim 1, wherein the ski pole cooperation section extends beyond a free end of the buckle.

15. The device as recited in claim 1, wherein the ski pole cooperation section extends beyond a side of a free end of the buckle.

16. A device provided on a buckle of a ski boot, the device comprising:

a buckle attachment section having a cavity which is dimensioned to receive a free end of the buckle therein to prevent unwanted movement of the buckle attachment section relative to the buckle;

a ski pole cooperation section having a ski pole receiving opening, the ski pole receiving opening extends through the ski pole cooperation section and is dimensioned to receive an end of a ski pole therein;

a securing member which secures the device to the buckle of the ski boot, wherein the device allows the buckles of the ski boot to be latched and unlatched with minimal twisting of the skier's body.

17. A method of latching or unlatching a buckle of a ski boot, the method comprising:

positioning a buckle attachment device onto a free end of the buckle;

securing the buckle attachment device onto the free end of the buckle;

inserting an end of a ski pole into a ski pole receiving opening of the buckle attachment device;

exerting force on the ski pole which causes a force to be exerted on the buckle attachment device and the buckle to move the buckle between a latched position and an unlatched position.

18. The method as recited in claim 17, wherein the force exerted on the ski pool pushes the buckle attachment device causing the buckle to move to the latched position.

19. The method as recited in claim 17, wherein the force exerted on the ski pool pulls the buckle attachment device causing the buckle to move to the unlatched position.

20. The method as recited in claim 17, wherein the skier rotates their arm to exert the force on the ski pole.

* * * * *